US010847132B1

(12) United States Patent
Miller et al.

(10) Patent No.: US 10,847,132 B1
(45) Date of Patent: Nov. 24, 2020

(54) WIND CHIME WITH SILENCER

(71) Applicant: Virtue Enterprising Pty Ltd., Jundah (AU)

(72) Inventors: Andrew John Miller, Jundah (AU); Megan Joy Miller, Jundah (AU)

(73) Assignee: Virtue Enterprising Pty Ltd., Jundah (AU)

( * ) Notice: Subject to any disclaimer, the term of this patent is extended or adjusted under 35 U.S.C. 154(b) by 0 days.

(21) Appl. No.: 15/930,178

(22) Filed: May 12, 2020

(51) Int. Cl.
*G10D 13/08* (2020.01)
*G10K 1/10* (2006.01)

(52) U.S. Cl.
CPC ..... *G10K 1/10* (2013.01); *G10D 13/08* (2013.01)

(58) Field of Classification Search
CPC ..... G10K 1/10; G10D 13/08
See application file for complete search history.

(56) References Cited

U.S. PATENT DOCUMENTS 9,024,161 B1 5/2015 Strong

*Primary Examiner* — Kimberly R Lockett
(74) *Attorney, Agent, or Firm* — Eric Karich; Karich & Associates

(57) ABSTRACT

A wind chime has a suspension system for suspending a plurality of chimes, a central cord that suspends a clapper adjacent the chimes, and a silencer slidably mounted on the central cord. The silencer includes a plurality of chime apertures radially spaced from a center area adjacent an outer perimeter, each sized and shaped to receive one of the plurality of chimes. The central cord extends through the silencer to a clapper. An adjustable locking mechanism is mounted on the central cord between the silencer and the clapper, for locking the silencer in either a silenced position wherein the main body is positioned inside of the plurality of chimes with each of the chimes being positioned within one of the chime apertures, and a stored position wherein the main body is positioned above the chimes.

6 Claims, 2 Drawing Sheets

WIND CHIME WITH SILENCER

BACKGROUND OF THE INVENTION

Field of the Invention

This invention relates generally to wind chimes, and more particularly to a wind chime silencer that slides between a stored position and a silenced position.

Description of Related Art

Strong, U.S. Pat. No. 9,024,161 teaches a wind chime silencer that may be removably attached to a wind chime for silencing the wind chime when desired. The silencer includes a plurality of recesses in the outer perimeter of the silencer for engaging the chimes. The silencer has a slit for removable attachment to a central cord of the chime.

The prior art teaches a wind chime silencer that may be removably mounted on the wind chime; however, in this case, the silencer must be completely removed for the wind chime to function. Once removed, the silencer can easily be lost or misplaced, so it is not available when needed. The prior art does not teach a silencer that can remain on the wind chime when not in use, so that is conveniently available for use when needed. The prior art does not teach a wind chime silencer that is integrally formed with the wind chime and includes an adjustable locking mechanism for sliding the silencer between stored and silenced positions.

The present invention fulfills these needs and provides further advantages as described in the following summary.

SUMMARY OF THE INVENTION

The present invention teaches certain benefits in construction and use which give rise to the objectives described below.

The present invention provides a wind chime comprising a suspension system for suspending a plurality of chimes; a central cord that suspends a clapper adjacent the chimes; and a silencer. The silencer includes a main body having a top surface and a bottom surface which together form a center area which extends radially to an outer perimeter; a plurality of chime apertures radially spaced from the center area adjacent the outer perimeter, each sized and shaped to receive one of the plurality of chimes; a central hole in the center area through which the central cord extends so that the main body is slidably mounted on the central cord above the clapper; and an adjustable locking mechanism on the central cord between the silencer and the clapper, for locking the silencer in either a silenced position wherein the main body is positioned inside of the plurality of chimes with each of the chimes being positioned within one of the chime apertures, and a stored position wherein the main body is positioned above the chimes.

A primary objective of the present invention is to provide a wind chime with silencer having advantages not taught by the prior art.

Another objective is to provide a wind chime having a silencer that remains on the wind chime so that it cannot be lost, the silencer being slidably mounted on the wind chime to slide between a stored position and a silenced position.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a wind chime that includes an integral silencer that can slide between a stored position and a silenced position.

Figure 1:
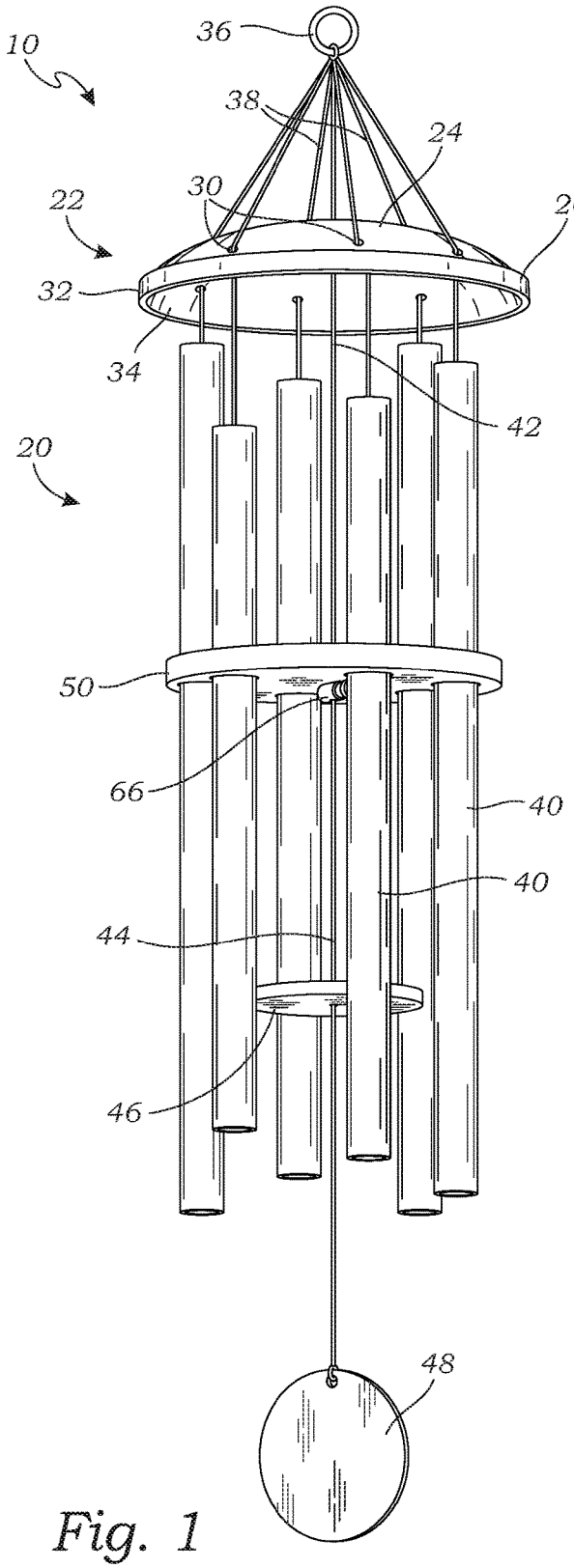
FIG. 1 is a bottom perspective view of a wind chime, according to one embodiment of the present invention, illustrating a silencer positioned in a silenced position to silence the wind chime.
Figure 2:
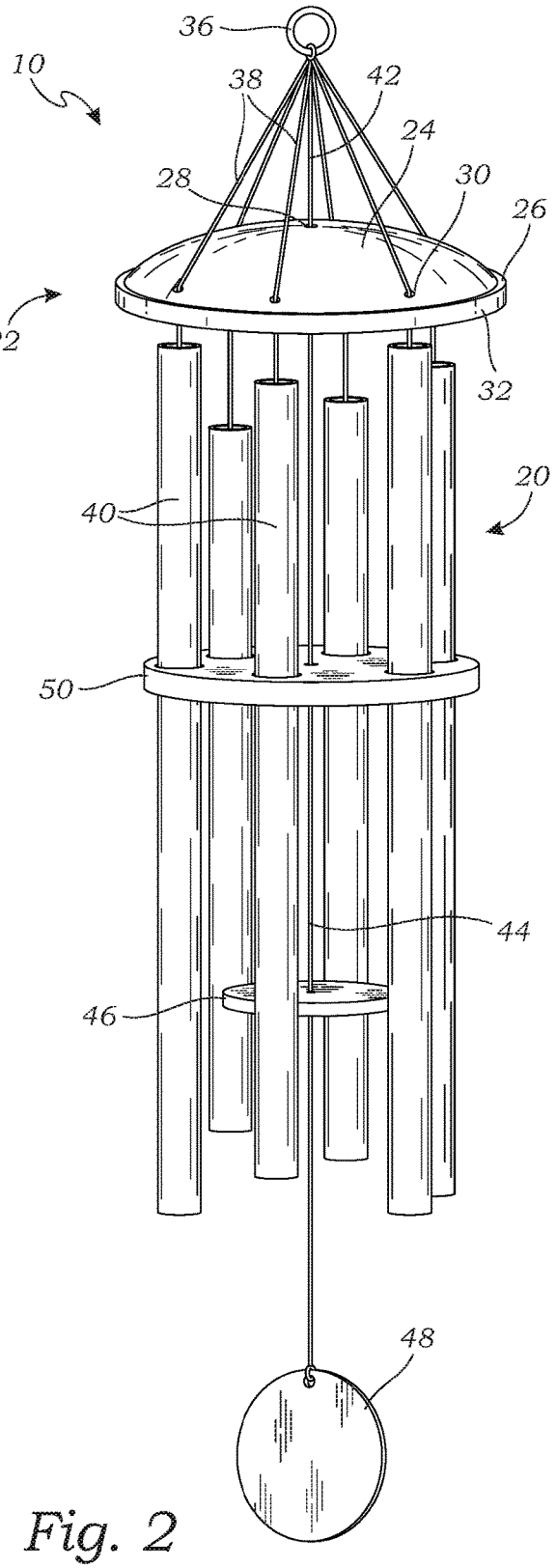
FIG. 2 is a top perspective view thereof.

FIG. 1 is a bottom perspective view of a wind chime 10, according to one embodiment of the present invention, illustrating a silencer 50 positioned in a silenced position to silence the wind chime 10. FIG. 2 is a top perspective view thereof. As shown in FIGS. 1-2, the wind chime 10 includes a chime generating device 20 for making chiming sounds when the wind is blowing, and a silencer 50 for selectively silencing the chime generating device 20 when desired.

As shown in FIGS. 1-2, the wind chime 10 includes a suspension system 22 for suspending a plurality of chimes 40 around a clapper 46. In this embodiment, the suspension system 22 is in the form of a suspension platform that extends outwardly from a center portion 24 to a platform perimeter 26. In this embodiment, there is a center hole 28 in the center portion 24, and a plurality of perimeter holes 30 that are radially spaced a distance from the center portion 24.

Figure 4:
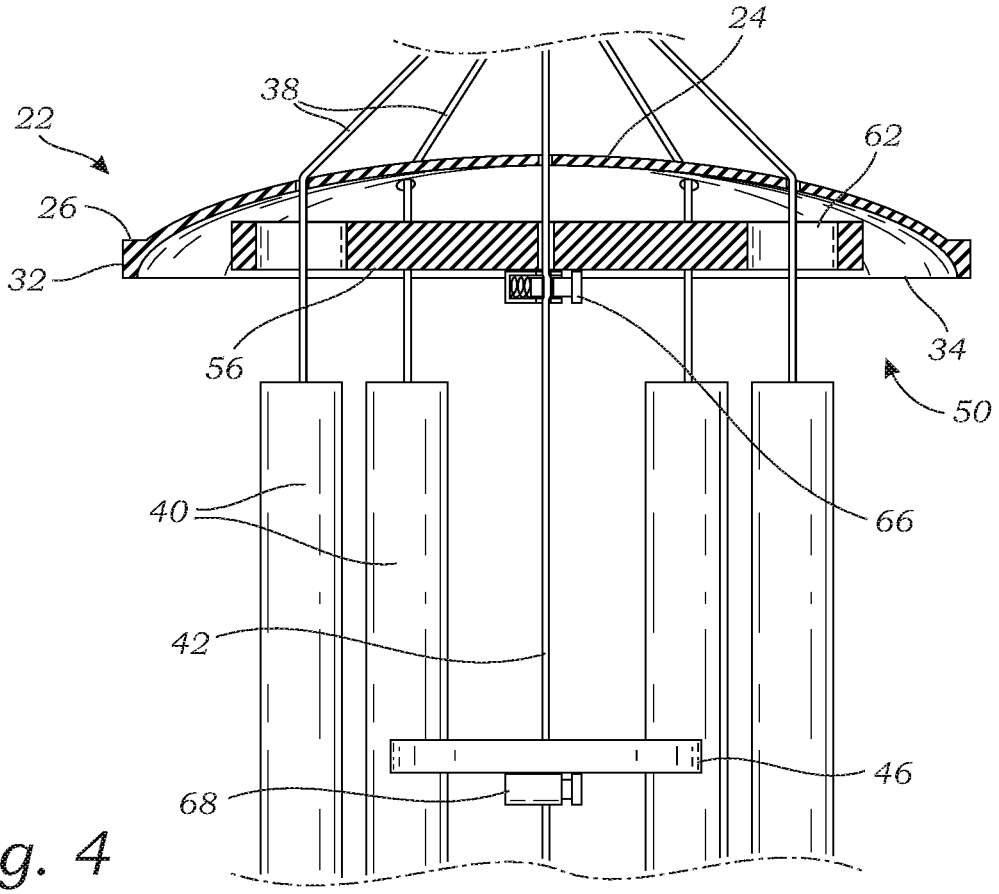
FIG. 4 is a side elevational sectional view of the wind chime, illustrating the silencer once it has been moved to a stored position.

In this embodiment, the suspension platform 22 further includes a downwardly extending flange 32 around the platform perimeter 26 such that the suspension platform 22 and the downwardly extending flange 32 together form a storage chamber 34 (which is also illustrated in FIG. 4). While one embodiment of this suspension system 22 is illustrated, it does not have to be in the form of the suspension platform shown herein, but may have alternative constructions known in the art of wind chimes (e.g., a ring, various forms of frames, and alternative structures for spacing the various cords of the chime).

A hanging element 36 has suspension cords 38 that each extend through one of the perimeter holes of the suspension platform 22, the suspension cords 38 each extending to one of a plurality of chimes 40. In this embodiment, each of the chimes 40 is in the form of a tube to form a chime tube, the chime tubes 40 being discussed in more detail below. In alternative embodiments, the chimes 40 may have alternative shapes such as are commonly used in prior art wind chimes.

With regards to the suspension cords 38, the term "cord" is hereby broadly defines to include any form of cord, string, wire, chain, ribbon, or any other structure known in the art. The suspension cords 38 may further be covered in plastic, or otherwise reinforced, decorated, woven, etc. In this embodiment, the hanging element 36 is in the form of a ring hook, but in other embodiments, the hanging element 36 may be any element that may hang the suspension cords 38 from a hanging point (e.g., a tie or loop fastener, hook, clip, etc.). A central cord 42 further extends from the hanging element 36, through the center hole 28 of the suspension platform 22, to a distal end 44 with the clapper 46 mounted thereupon. In this embodiment, the central cord 42 terminates in a sail 48, below the clapper 46, which manipulates movement of the central cord 42. However, in other embodiments, the chime generating device 20 may have the clapper 46 only, without the sail 48, depending upon the requirements of the product designer.

In some embodiments, the chime tubes 40 are in the form of elongate hollow tubes, which are commonly constructed of aluminum, steel, bamboo, ceramic, etc., or any other material known to those in the art. The chime tubes 40 may hang from the suspension cords 38 in a variety of ways, e.g., apertures in tops of the chime tubes 40, via an adhesive, friction, etc., or using any other means of hanging the chime tubes 40 devised by one skilled in the art. In this embodiment, there are six chime tubes, but in other embodiments, there may be greater or fewer than this, corresponding to the number of suspension cords 38.

Figure 3:
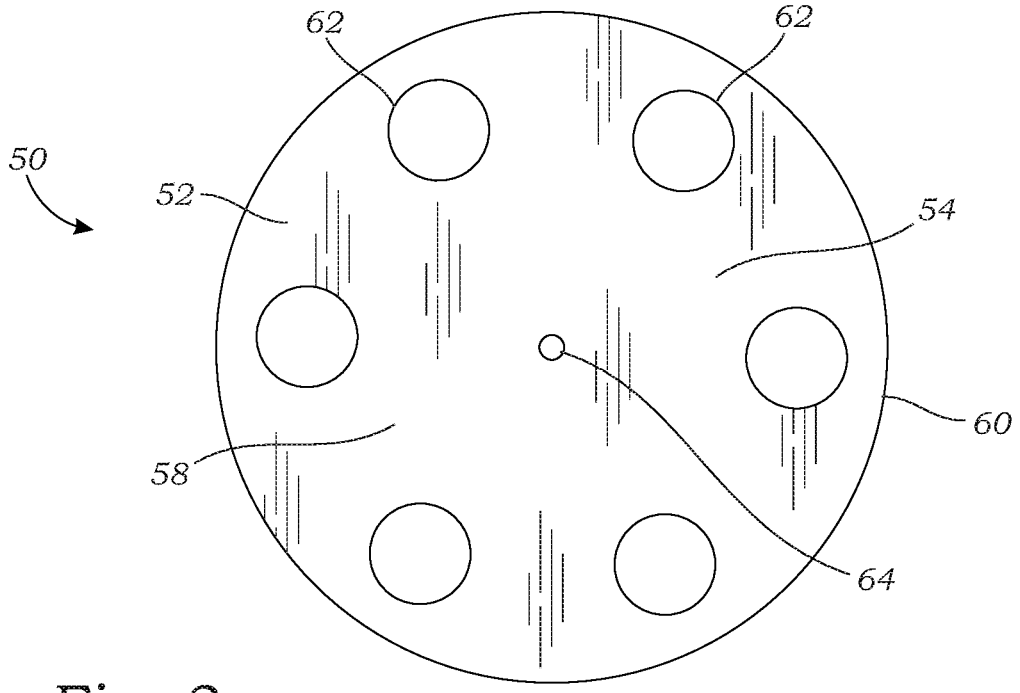
FIG. 3 is a top plan view of the silencer.

FIG. 3 is a top plan view of the silencer 50 separated from the wind chime 10 of FIGS. 1 and 2. The silencer 50 shown in FIG. 3 is integrally formed with the chime generating device 20, and is not intended to be removed, but remains attached to the chime 10 so that it cannot be lost. As discussed below, when not in use, the silencer 50 is instead moved to a stored position, shown in FIG. 4, rather than removed, as is done by the prior art.

As shown in FIG. 3, the silencer 50 comprises a main body 52 having a top surface 54 and a bottom surface 56 which together form a center area 58 which extends radially to an outer perimeter 60. The main body 52 may be formed of any suitable materials, in this case a soft yet somewhat rigid material, such as foam, rubber, felt, etc., or any other material suitable for silencing the chime tubes 40 without damaging them. The plurality of chime apertures 62 are radially spaced from the center area 58 adjacent the outer perimeter 60, each sized and shaped to receive one of the plurality of chime tubes 40. For purposes of this application, the term "aperture" is defined to include a hole through the main body 52 which entirely surrounds the chime 40, or any form of recess or bore which partially surrounds the chime 40. The plurality of chime apertures 62 may be manufactured to accommodate a variety of chime tube diameters and shapes; further, as mentioned above, there may be a wide range in the number of chime apertures 62 provided.

The center area 58 of the main body 52 has a central hole 64, and the central cord 42 extends through the central hole 64, such that the main body 52 of the silencer 50 is positioned above the clapper 46. The main body 52 is slidably mounted on the central cord 42, so that the silencer 50 slides upwardly or downwardly along the central cord 42 of the chime generating device 20 between a silenced position, shown in FIGS. 1-2, wherein the main body 52 is positioned on the plurality of chime tubes 40 with each of the chime tubes 40 being positioned within one of the chime apertures 62, and a stored position, shown in FIG. 4 and discussed below. In the silenced position, the plurality of chime tubes 40 fit snugly within their respective chime aperture of the silencer 50 so that the chime tubes 40 are prevented from contacting the clapper 46 or each other in the silenced position, thus silencing the chime generating device 20.

FIG. 4 is a side elevational sectional view of the wind chime 10, illustrating the silencer 50 in the stored position. As shown in FIG. 4, in the stored position, the main body 52 is positioned above the plurality of tubes, in this case positioned within the storage chamber 34 of the suspension platform 22. The storage chamber 34 is shaped to receive the silencer 50, which fits within the storage chamber 34 in the stored position and is not in contact with the chime tubes 40.

The silencer 50 of this embodiment includes the central hole 64 (shown in FIG. 3) that completely surrounds the central cord 44 so that the silencer 50 cannot be removed from the wind chime 10 without at least partially disassembling the wind chime, 10 disconnecting either the suspension system 22 or the clapper 46 (shown in FIG. 1).

As shown in FIGS. 1 and 4, an adjustable locking mechanism 66 is mounted on the central cord 42 between the silencer 50 and the clapper 46, for locking the silencer 50 in either the silenced or stored positions. In this embodiment, the locking mechanism 66 is in the form of a spring clamp which is spring-biased to clamp the cord 42, but which can be released while compressing the mechanism 66. In alternative embodiments, however, the locking mechanism 66 may be any other form of clamp that can be readily adjusted according to the teachings of this invention (e.g., mechanical stops, clips, twist-fasteners, rings, etc.). In some embodiments, a second cord lock 68 may be located on the central cord 42 below the clapper 46; however, alternatively any other form of attaching the clapper 46 known in the art may be used, as adjustment is not required.

In another embodiment, another means for locking may be used in place of the locking mechanism 66. In addition to the different mechanical mechanisms discussed above, the locking may alternatively be achieved due to the friction between the central cord 42 and the silencer 50. Those skilled in the art may device alternative mechanisms and systems, and such alternatives should be considered within the scope of the present invention.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A wind chime comprising:

a suspension system for suspending a plurality of chimes;

a central cord that suspends a clapper adjacent the chimes; and a silencer comprising:

a plurality of chime apertures through the silencer, each sized and shaped to receive one of the plurality of chimes;

a central hole through the silencer through which the central cord extends so that the silencer is slidably mounted on the central cord above the clapper, so that the silencer can slide between a silenced position wherein the silencer abuts the plurality of chimes with each of the chimes being positioned within one of the chime apertures, and a stored position wherein the silencer is positioned above the chimes; and wherein the silencer completely surrounds the central cord so that the silencer cannot be removed from the wind chime without at least partially disassembling the wind chime, disconnecting either the suspension system or the clapper.

2. A wind chime comprising:

a suspension system for suspending a plurality of chimes;

a central cord that suspends a clapper adjacent the chimes; and a silencer comprising:

a main body having a top surface and a bottom surface which together form a center area which extends radially to an outer perimeter;

a plurality of chime apertures radially spaced from the center area adjacent the outer perimeter, each sized and shaped to receive one of the plurality of chimes;

a central hole in the center area through which the central cord extends so that the main body is slidably mounted on the central cord above the clapper; and an adjustable locking mechanism on the central cord between the silencer and the clapper, for locking the silencer in either a silenced position wherein the main body is positioned inside of the plurality of chimes with each of the chimes being positioned within one of the chime apertures, and a stored position wherein the main body is positioned above the chimes.

3. A wind chime comprising:

a suspension platform that extends outwardly from a center portion to a platform perimeter, the suspension platform having a center hole in the center portion, and a plurality of perimeter holes that are radially spaced a distance from the center portion;

a plurality of chime tubes;

a plurality of chime suspension cords that each extend from a hanging element, through one of the perimeter holes of the suspension platform, to one of the chime tubes;

a central cord that extends from the hanging element, through the center hole of the suspension platform, to a distal end;

a clapper mounted on the distal end of the central cord; and a silencer comprising:

a main body having a top surface and a bottom surface which together form a center area which extends radially to an outer perimeter;

a plurality of chime apertures radially spaced from the center area adjacent the outer perimeter, each sized and shaped to receive one of the plurality of chime tubes;

a central hole in the center area, the main body of the silencer being positioned above the clapper so that the central cord extends through the central hole and the main body is slidably mounted on the central cord, so that the silencer slides upwardly or downwardly along the central cord of the wind chime between a silenced position wherein the main body is positioned on the plurality of chime tubes with each of the chime tubes being positioned within one of the chime apertures, and a stored position wherein the main body is positioned above the plurality of tubes; and an adjustable locking mechanism on the central cord between the silencer and the clapper, for locking the silencer in either the silenced or stored positions.

4. The wind chime of claim 3, wherein the suspension platform includes a downwardly extending flange around the platform perimeter such that the suspension platform and the downwardly extending flange together form a storage chamber shaped to receive the silencer, and wherein the silencer fits within the storage chamber when in the stored position.

5. The wind chime of claim 3, wherein the plurality of chime tubes fit snugly within their respective chime aperture of the silencer so that the chime tubes are prevented from contacting the clapper or each other in the silenced position, thus silencing the wind chime.

6. The wind chime of claim 3, wherein a second cord lock is located on the central cord below the clapper.

* * * * *